US006976910B2

(12) United States Patent
Hosaka et al.

(10) Patent No.: US 6,976,910 B2
(45) Date of Patent: Dec. 20, 2005

(54) POLISHING PAD

(75) Inventors: Yukio Hosaka, Tokyo (JP); Hiroshi Shiho, Tokyo (JP); Kou Hasegawa, Tokyo (JP); Nobuo Kawahashi, Tokyo (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 10/849,782

(22) Filed: May 21, 2004

(65) Prior Publication Data

US 2005/0003749 A1 Jan. 6, 2005

(30) Foreign Application Priority Data

May 23, 2003 (JP) ..... 2003-146458

(51) Int. Cl.[7] ..... B24D 11/00
(52) U.S. Cl. ..... 451/530; 451/528
(58) Field of Search ..... 451/526, 527, 451/528, 533, 537, 530, 41, 28

(56) References Cited

U.S. PATENT DOCUMENTS

| | | | | |
|---|---|---|---|---|
| 5,913,713 | A | 6/1999 | Cheek et al. | |
| 6,093,085 | A * | 7/2000 | Yellitz et al. | 451/41 |
| 6,217,426 | B1 * | 4/2001 | Tolles et al. | 451/285 |
| 6,705,923 | B2 * | 3/2004 | Liu et al. | 451/7 |
| 2001/0008830 | A1 | 7/2001 | Tolles et al. | |
| 2002/0010232 | A1 * | 1/2002 | Ogawa et al. | 523/448 |
| 2005/0095958 | A1 * | 5/2005 | Yun et al. | 451/41 |

FOREIGN PATENT DOCUMENTS

| | | |
|---|---|---|
| EP | 1 252 973 A1 | 10/2002 |
| JP | 8 500622 | 1/1996 |
| JP | 8-39423 | 2/1996 |
| JP | 8-216029 | 8/1996 |
| JP | 11-70463 | 3/1999 |
| JP | 2000-33552 | 2/2000 |
| JP | 2000-34416 | 2/2000 |
| JP | 2001-334455 | 12/2001 |
| WO | WO 94/04599 | 3/1994 |
| WO | WO 02/02279 A2 | 1/2002 |

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

A polishing pad comprising a recessed portion in the non-polishing surface. This polishing pad can prevent the surface to be polished of an object from being scratched.

15 Claims, No Drawings

POLISHING PAD

FIELD OF THE INVENTION

The present invention relates to a polishing pad used for chemical mechanical polishing.

DESCRIPTION OF THE PRIOR ART

CMP (Chemical Mechanical Polishing) has been attracting much attention as a polishing technique capable of forming a surface having high flatness. CMP is a technique for polishing by spreading CMP slurry which is an aqueous dispersion of abrasive grains over the surface of a polishing pad while the polishing pad and the surface to be polished are brought into slide contact with each other. It is known that the polishing result is greatly affected by the characteristic properties of the polishing pad in this CMP.

CMP has been carried out by using a polyurethane foam having pores as a polishing pad and holding slurry in the pores open to the surface of this resin. It is known that the removal rate and the polishing result are improved by forming grooves on the polishing side of the polishing pad (JP-A 11-70463, JP-A 8-216029 and JP-A 8-39423) (the term "JP-A" as used herein means an "unexamined published Japanese patent application").

However, since it is extremely difficult to control foaming when a polyurethane foam is used as the material of the polishing pad, there occur such problems as variations in the quality of the polishing pad, the removal rate and the processing state. Especially, a scratch-like surface defect (to be referred to as "scratch" hereinafter) may be produced, and it is desired to improve this.

A polishing pad comprising a water-soluble polymer dispersed in a matrix resin is proposed as a polishing pad capable of forming pores without using a foam (JP-A 8-500622, JP-A 2000-34416, JP-A 2000-33552 and JP-A 2001-334455).

In this technology, pores are formed by the contact with and dissolution in CMP slurry or water of the water-soluble polymer dispersed in the matrix resin during polishing. Although this technology has an advantage that the dispersion state of the pores can be controlled arbitrarily, it may not suppress the occlusion of the pores during polishing or after dressing, whereby a satisfactory removal rate and the good surface state of a polished object may not be obtained. Therefore, a drastic solution to these problems is desired.

In the case of a conventionally known polishing pad, supplied CMP slurry may not be spread over the polishing pad uniformly, whereby the removal rate and the surface state of the polished object may become unsatisfactory. A solution to these problems is desired.

SUMMARY OF THE INVENTION

It is an object of the present invention to provide a polishing pad used for chemical mechanical polishing, which solves the above problems of the prior art and can completely prevent the surface to be polished from being scratched.

Other objects and advantages of the present invention will become obvious from the following description.

According to the present invention, the above objects and advantages of the present invention are attained by a polishing pad used for chemical mechanical polishing, which has a polishing surface and a non-polishing surface and comprises a recessed portion open to the non-polishing surface.

The inventors of the present invention have studied in detail the mechanism that the surface to be polished is scratched by polishing with a conventionally known polishing pad and have found that this is caused by excessive pressure generated around the center portion of the pad. The present invention has been accomplished based on this finding.

The above recessed portion is open to the non-polishing surface of the polishing pad. This recessed portion serves to scatter pressure applied to the polishing pad by the polishing head at the time of polishing in order to prevent a local rise in pressure. The position of the recessed portion is not particularly limited but preferably at the center portion of the pad. The expression "at the center portion" means not only that the recessed portion is located at the center in a strictly mathematical sense but also that the center of the non-polishing surface of the polishing pad is located within the area of the above recessed portion.

The opening of the recessed portion is not limited to a particular shape but preferably circular or polygonal and particularly preferably circular. When the opening of the recessed portion is circular, the upper limit of its diameter is preferably 100%, more preferably 75%, particularly preferably 50% of the diameter of a wafer which is an object to be polished. When the opening of the recessed portion is circular, the lower limit of its diameter is preferably 1 mm, more preferably 5 mm regardless of the size of the wafer to be polished.

When the diameter of the wafer to be polished is, for example, 300 mm, the diameter of the recessed portion having a circular opening is preferably 1 to 300 mm, more preferably 1 to 225 mm, particularly preferably 5 to 150 mm. When the diameter of the wafer to be polished is 200 mm, the diameter of the recessed portion having a circular opening is preferably 1 to 200 mm, more preferably 1 to 150 mm, particularly preferably 5 to 100 mm.

The depth of the recessed portion is preferably 0.01 to 2.0 mm, more preferably 0.1 to 1.5 mm, particularly preferably 0.1 to 1.0 mm.

The polishing pad of the present invention may optionally have grooves or other recessed portions having an arbitrary shape which are open to the polishing surface. The grooves are, for example, concentrically circular, lattice-like, spiral or radical. As for the other recessed portions, a large number of circular or polygonal recessed portions may be formed on the polishing surface.

The entire polishing pad of the present invention is not limited to a particular shape but may be disk-like, polygonal, etc. The shape of the polishing pad may be suitably selected according to a polishing machine to be used with the polishing pad of the present invention.

The polishing pad is not limited to a particular size. In the case of a disk-like polishing pad, it can have a diameter of 150 to 1,200 mm, preferably 500 to 800 mm and a thickness of 1.0 to 5.0 mm, preferably 1.5 to 3.0 mm.

The polishing pad of the present invention may be made of any material if it has the above recessed portion. For example, it may be composed of a water-insoluble matrix material and water-soluble particles dispersed in the water-insoluble matrix material or of a water-insoluble matrix material and pores dispersed in the matrix material.

An organic material is preferably used to form the above water-insoluble matrix material because it is easily molded to a predetermined shape and a molded product having suitable hardness and elasticity is obtained. Examples of the organic material include rubbers, curable resins such as thermally curable resins and photocurable resins which are crosslinked and cured by external energy such as heat and light, thermoplastic resins and elastomers. They may be used alone or in combination.

The above rubbers include butadiene rubbers such as 1,2-polybutadiene; conjugated diene rubbers such as isoprene rubber, styrene-butadiene rubber and styrene-isoprene rubber; nitrile rubbers such as acrylonitrile-butadiene rubber; acrylic rubber; ethylene-α-olefin rubbers such as ethylene-propylene rubber and ethylene-propylene diene rubber; and butyl rubber, silicone rubber and fluorine rubber. These rubbers may be crosslinked by sulfur or organic peroxide.

The above curable resins include urethane resins, epoxy resins, acrylic resins, unsaturated polyester resins, polyurethane-urea resins, urea resins, silicon resins, phenolic resins and vinyl ester resins.

The above thermoplastic resins include 1,2-polybutadiene resin, polyolefin resins such as polyethylene, polystyrene resins, polyacrylic resins such as (meth)acrylate resins, vinyl ester resins (excluding acrylic resins), polyester resins, polyamide resins, fluororesin, polycarbonate resins and polyacetal resins. Out of these thermoplastic resins, resins which can be crosslinked chemically with an organic peroxide or optically with radiation such as an electron beam may be crosslinked or not crosslinked.

The above elastomers include diene elastomers such as 1,2-polybutadiene; polyolefin elastomers (TPO); thermoplastic elastomers such as styrenic elastomers including styrene-butadiene-styrene block copolymer (SBS) and hydrogenated block copolymers thereof (SEBS), thermoplastic polyurethane elastomers (TPU), thermoplastic polyester elastomers (TPEE) and polyamide elastomers (TPAE); silicone resin elastomers and fluororesin elastomers. These elastomers may be crosslinked or not crosslinked.

The above organic materials may be modified by an acid anhydride group, carboxyl group, hydroxyl group, epoxy group or amino group. The compatibility with the water-soluble particles to be described hereinafter and slurry of the organic material can be adjusted by modification.

These organic materials may be used alone or in combination of two or more.

The polishing pad of the present invention is preferably made of an organic material containing a crosslinked polymer out of these organic materials. When a crosslinked polymer is contained, the surface roughness of the inner wall of each groove can be controlled to 20 μm or less, thereby contributing to the improvement of the condition of the surface to be polished and making it possible to provide elastic recovery force to the water-insoluble matrix material. Therefore, displacement caused by shear stress applied to the polishing pad at the time of polishing can be suppressed. Further, it is possible to effectively prevent the pores from being filled by the plastic deformation of the water-insoluble matrix material when it is excessively stretched at the time of polishing and dressing and the surface of the polishing pad from being fluffed excessively. Consequently, the pores are formed efficiently at the time of dressing as well, a reduction in the retainability of the slurry at the time of polishing can be prevented, and a polishing pad which is rarely fluffed and is not prevented from providing polishing flatness can be obtained.

Out of the above organic materials, rubbers, curable resins, crosslinked thermoplastic resins and crosslinked elastomers may be used as the crosslinked polymer. Further, crosslinked rubbers are particularly preferred because they are stable to a strong acid or strong alkali contained in many kinds of slurry and is rarely softened by water absorption. Out of the crosslinked rubbers, what are crosslinked with an organic peroxide are preferred, and crosslinked 1,2-polytadiene is particularly preferred because a crosslinked product having higher hardness is easily obtained from 1,2-polybutadiene than other rubbers.

The amount of the crosslinked polymer contained in the water-insoluble matrix is 20 vol % or more, more preferably 30 vol % or more, much more preferably 40 vol % or more and may be 100 vol % based on 100 vol % of the water-insoluble matrix material. When the amount of the crosslinked polymer contained in the water-insoluble matrix is smaller than 20 volt, the effect obtained by the addition of the crosslinked polymer may not be fully obtained.

The residual elongation after breakage (to be simply referred to as "residual elongation at break" hereinafter) of the above water-insoluble matrix material containing a crosslinked polymer is preferably 100% or less when a specimen of the above water-insoluble matrix material is broken at 80° C. in accordance with JIS K 6251. This means that the total distance between bench marks of the specimen after breakage is preferably 2 times or less the distance between the bench marks before breakage. This residual elongation at break is preferably 30% or less, more preferably 10% or less, particularly preferably 5% or less. When the above residual elongation at break is higher than 100%, fine pieces scraped off from the surface of the polishing pad or stretched at the time of polishing and surface renewal tend to fill the pores. The "residual elongation at break" is an elongation obtained by subtracting the distance between bench marks before the test from the total distance between each bench mark and the broken portion of the broken and divided specimen in a tensile test in which a dumbbell-shaped specimen No. 3 is broken at a tensile rate of 500 mm/min and a test temperature of 80° C. in accordance with the "vulcanized rubber tensile test method" specified in JIS K 6251. The test temperature is 80° C. as the temperature reached by slide contact at the time of actual polishing process.

The above "water-soluble particles" separate from the water-insoluble matrix material when they come into contact with slurry which is an aqueous dispersion in the polishing pad. This separation occurs when they are dissolved in water contained in the slurry upon their contact with water or when they swell and gel by absorbing this water. Further, this dissolution or swelling is caused not only by their contact with water but also by their contact with an aqueous mixed medium containing an alcohol-based solvent such as methanol.

The water-soluble particles have the effect of increasing the indentation hardness of the polishing pad in addition to the effect of forming pores. For example, the shore D hardness of the polishing pad of the present invention is preferably set to 35 or more by adding the water-soluble particles. This shore D hardness is more preferably 35 to 100, much more preferably 50 to 90, particularly preferably 60 to 85. When the shore D hardness is 35 or more, pressure applied to the object to be polished can be increased, and the removal rate can be thereby improved. In addition, high polishing flatness is obtained. Therefore, the water-soluble particles are particularly preferably a solid substance which can ensure sufficiently high indentation hardness for the polishing pad.

The water-soluble particles are, for example, organic water-soluble particles or inorganic water-soluble particles.

Examples of the material for forming the organic water-soluble particles include dextrin, cyclodextrin, mannitol, saccharides such as lactose, celluloses such as hydroxypropyl cellulose and methyl cellulose, starch, protein, polyvinyl alcohol, polyvinyl pyrrolidone, polyacrylic acid, polyethylene oxide, water-soluble photosensitive resins, sulfonated polyisoprene and sulfonated polyisoprene copolymers. Examples of the material for forming the inorganic water-soluble particles include potassium acetate, potassium nitrate, potassium carbonate, potassium hydrogencarbonate, potassium chloride, potassium bromide, potassium phosphate and magnesium nitrate. These water-soluble particles may be used alone or in combination of two or more. The water-soluble particles may be made of a predetermined single material, or two or more different materials.

The water-soluble particles have an average particle diameter of preferably 0.1 to 500 $\mu$m, more preferably 0.5 to 100 $\mu$m. The pores are as big as preferably 0.1 to 500 $\mu$m, more preferably 0.5 to 100 $\mu$m. When the average particle diameter of the water-soluble particles is smaller than 0.1 $\mu$m, the formed pores become smaller in size than the commonly used abrasive grains, whereby a polishing pad capable of holding slurry completely may hardly be obtained. When the average particle diameter is larger than 500 $\mu$m, the formed pores become too large, whereby the mechanical strength of the obtained polishing pad and the removal rate may lower.

The amount of the water-soluble particles is preferably 90 vol % or less, more preferably 0.1 to 90 vol %, much more preferably 0.1 to 60 vol %, particularly preferably 0.5 to 40 vol % based on 100 vol % of the total of the water-insoluble matrix material and the water-soluble particles. When the water-soluble particles are contained in an amount of more than 90 vol %, it is difficult to completely prevent the water-soluble particles existent in the interior of the obtained polishing pad from swelling or dissolving, whereby the hardness and mechanical strength of the obtained polishing pad may not be maintained at appropriate values.

It is preferred that the water-soluble particles should dissolve in water only when they are exposed to the surface layer of the polishing pad and should not absorb moisture or swell when they are existent in the interior of the polishing pad. Therefore, the water-soluble particles may have an outer shell for suppressing moisture absorption on at least part of their outermost portion. This outer shell may be physically adsorbed to the water-soluble particle, chemically bonded to the water-soluble particle, or in contact with the water-soluble particle by physical adsorption and chemical bonding. The outer shell is made of epoxy resin, polyimide, polyamide or polysilicate. Even when it is formed on only part of the water-soluble particle, the above effect can be fully obtained.

The water-insoluble matrix material may contain a compatibilizing agent to control its compatibility with the water-soluble particles and the dispersibility in the water-insoluble matrix material of the water-soluble particles. Examples of the compatibilizing agent include homopolymers, block copolymers and random copolymers modified by an acid anhydride group, carboxyl group, hydroxyl group, epoxy group, oxazoline group or amino group, nonionic surfactants and coupling agents.

Besides the above compatibilizing agent, the water-insoluble matrix material may further contain at least one selected from additives which have been contained in slurry, such as an abrasive grain, oxidizing agent, alkali metal hydroxide and acid, pH modifier, surfactant and scratch preventing agent. When the water-insoluble matrix material contains one of the above additives, polishing can be carried out by supplying only water at the time of polishing.

Other additives such as a filler, softening agent, antioxidant, ultraviolet light absorber, antistatic agent, lubricant and plasticizer may be further contained. Reactive additives such as sulfur or peroxide may be added to react the water-insoluble matrix material for crosslinking. Examples of the filler include materials for improving stiffness such as calcium carbonate, magnesium carbonate, talc and clay, and materials having a polishing effect such as silica, alumina, ceria, zirconia, titania, zirconium oxide, manganese dioxide, dimanganese trioxide and barium carbonate.

The above "pad having pores in the water-insoluble matrix" is composed of a polyethylene foam, polyurethane foam or polystyrene foam.

As for the method of manufacturing the polishing pad of the present invention, a composition for a polishing pad which will become a polishing pad is prepared and molded to a desired shape, and a recessed portion is formed by cutting or the like, or a composition for a polishing pad is molded with a mold having a projection portion for forming the recessed portion to manufacture a polishing pad having a recessed portion.

The composition for a polishing pad may be prepared by kneading together required materials including a specific organic material with a mixer. The mixer is a known device such as a roll, kneader, Banbury mixer or extruder (single-screw or multi-screw).

The composition for manufacturing a polishing pad containing water-soluble particles can be prepared, for example, by kneading together a water-insoluble matrix material, water-soluble particles and other additives. Advantageously, they are kneaded together under heating so that they can be processed at the time of kneading. The water-soluble particles are preferably solid at the kneading temperature. When they are solid, they can be dispersed with the above preferred average particle diameter irrespective of their compatibility with the water-insoluble matrix material.

Therefore, the type of the water-soluble particles is selected according to the processing temperature of the water-insoluble matrix material in use.

A laminated polishing pad can be manufactured by forming a base layer on the non-polishing side of the above polishing pad of the present invention.

The above base layer is a layer for supporting a polishing layer on the non-polishing side which is the rear side opposite to the polishing layer. Although the characteristic properties of this base layer are not particularly limited, it is preferably softer than the polishing layer. When the laminated polishing pad has a soft base layer, if the thickness of the polishing layer is small, for example, 1.0 mm or less, it is possible to prevent the polishing layer from rising and the surface of the polishing layer from curving at the time of polishing, whereby polishing can be carried out stably. The hardness of the base layer is preferably 90% or less, more preferably 50 to 90%, much more preferably 50 to 80%, particularly preferably 50 to 70% of the hardness of the polishing layer. The shore D hardness of the base layer is preferably 70 or less, more preferably 60 or less, particularly preferably 50 or less.

The base layer may be made of a porous material (foam) or non-porous material. Further, its planar shape is not particularly limited and may be the same or different from that of the polishing layer. This base layer may be, for example, circular or polygonal such as tetragonal. The thickness of the base layer is preferably 0.1 to 5 mm, more preferably 0.5 to 2 mm.

The material for forming the base layer is preferably an organic material because it is easily molded to have a predetermined shape and predetermined properties and can provide suitable elasticity. The same material as that used to form the water-insoluble matrix material of the above polishing pad may be used. The organic material for forming the base layer may be a crosslinked polymer or non-crosslinked polymer.

The polishing pad of the present invention is set in a commercially available polishing machine to be used for CMP in accordance with a known method.

EXAMPLES

The following examples are given to further illustrate the present invention. However, it is to be understood that the effect of the present invention is obtained without limiting the diameter, thickness and composition of these pads.

Example 1

(1) Manufacture of Polishing Pad 80 parts by volume of 1,2-polybutadiene (JSR RB830 (trade name) of JSR Corporation) which would be crosslinked later to become a water-insoluble matrix and 20 parts by volume of β-cyclodextrin (Dexy Pearl β-100 of Bio Research Corporation of Yokohama, average particle diameter of 20 μm) as water-soluble particles were kneaded together by an extruder heated at 160° C. Thereafter, dicumyl peroxide (Percumyl D of NOF Corporation) was added in an amount of 1.0 part by weight and further kneaded at 120° C. to obtain a pellet. Then, the kneaded product was crosslinked by heating in a mold at 170° C. for 18 minutes to mold a disk-like molded product having a diameter of 600 mm and a thickness of 2.5 mm. Thereafter, concentric grooves having a width of 0.5 mm, a pitch of 2.0 mm and a depth of 1.0 mm were formed on the polishing side of this molded product by a commercially available cutting machine.

Further, a circular recessed portion having a diameter of 50 mm and a depth of 0.5 mm was formed on the non-polishing side by spot facing at a position where it is almost concentric to the polishing surface.

(2) Removal Rate and the Number of Scratches

The above manufactured polishing pad was set on the platen of a polishing machine (EPO112 of Ebara Corporation) to polish a wafer having a non-patterned $SiO_2$ film (PETEOS film; $SiO_2$ film formed from tetraethyl orthosilicate (TEOS) by chemical vapor deposition using plasma as a promoter) by using CMS-1101 (trade name, manufactured by JSR Corporation) diluted to 3 times as CMP slurry under the following conditions. The removal rate and the number of scratches were evaluated. As a result, the removal rate was 210 nm/minute and the number of scratches was 2.

Revolution of platen: 70 rpm

Revolution of head: 63 rpm

Pressure of head: 4 psi

Feed rate of slurry: 200 mL/min

Polishing time: 2 minutes

The removal rate was calculated from the thicknesses of the polishing pad before and after polishing measured with an optical film thickness meter. The total number of scratches on the polished whole surface of the $SiO_2$ film wafer were counted with a wafer defect inspection device (KLA2351 of KLA Ten Call Co. Ltd.).

Example 2

A pellet comprising 1,2-polybutadiene, β-cyclodextrin and dicumyl peroxide was obtained in the same manner as in Example 1. Thereafter, it was crosslinked by heating in a mold having a 50 mm-diameter and 0.5 mm-deep projection at the center of a bottom force at 170° C. for 18 minutes in order to obtain a disk-like molded product having a diameter of 600 mm, a thickness of 2.5 mm and a 50 mm-diameter and 0.5 mm-deep recessed portion which was open to the non-polishing side. Concentric grooves having a width of 0.5 mm, a pitch of 2.0 mm and a depth of 1.0 mm were formed on the polishing side of this molded product by a cutting machine.

The removal rate and the number of scratches were evaluated in the same manner as in Example 1 except that the above polishing pad was used. As a result, the removal rate was 200 nm/min and the number of scratches was 3.

Example 3

98 parts by volume of 1,2-polybutadiene (JSR RB830 (trade name) of JSR Corporation) which would be crosslinked later to become a water-insoluble matrix and 2 parts by volume of β-cyclodextrin (Dexy Pearl β-100 of Bio Research Corporation of Yokohama, average particle diameter of 20 μm) as water-soluble particles were kneaded together by an extruder heated at 160° C. Thereafter, dicumyl peroxide (Percumyl D40 (trade name) of NOF Corporation) was added in an amount of 0.9 part by weight and further kneaded at 120° C. to obtain a pellet. Then, the kneaded product was crosslinked by heating in a mold at 170° C. for 18 minutes to obtain a molded product having a diameter of 600 mm and a thickness of 3.0 mm. Thereafter, both sides of the molded product were shaved by a thickness of 2.5 mm. Further, concentric grooves having a width of 0.5 mm, a pitch of 2.0 mm and a depth of 1.0 mm were formed on the polishing side of this molded product by a commercially available cutting machine.

Further, a circular recessed portion having a diameter of 78 mm and a depth of 0.5 mm was formed on the non-polishing side by spot facing at a position where it is almost concentric to the polishing surface.

The removal rate and the number of scratches were evaluated in the same manner as in Example 1 except that the above polishing pad was used. As a result, the removal rate was 190 nm/min and the number of scratches was 2.

Example 4

A disk-like molded product having a diameter of 600 mm and a thickness of 2.5 mm was obtained in the same manner as in Example 1. Thereafter, concentric grooves having a width of 0.5 mm, a pitch of 2.0 mm and a depth of 1.0 mm were formed on the polishing side of this molded product by a commercially available cutting machine.

Further, a hexagonal recessed portion having a depth of 0.5 mm and a diagonal length of 50 mm was formed on the non-polishing side at a position where it is almost concentric to the polishing surface.

The removal rate and the number of scratches were evaluated in the same manner as in Example 1 except that the above polishing pad was used. As a result, the removal rate was 210 nm/min and the number of scratches was 5.

Comparative Example 1

A disk-like molded product having the same size as that of Example 1 was obtained in the same manner as in Example 1, and concentric grooves having a width of 0.5 mm, a pitch of 2.0 mm and a depth of 1.0 mm were formed on the polishing side of this molded product by a commercially available cutting machine to manufacture a polishing pad having no recessed portion on the non-polishing side and grooves on the polishing side.

The removal rate and the number of scratches were evaluated in the same manner as in Example 1 except that the above polishing pad was used. As a result, the removal rate was 200 nm/min and the number of scratches was 15.

What is claimed is:

1. A polishing pad used for chemical mechanical polishing, which has a polishing surface and a non-polishing surface and comprises a recessed portion open to the non-polishing surface, wherein said recessed portion is located at the center of said non-polishing surface in a strictly mathematical sense or the center of said non-polishing surface is located within the area of said recessed portion, and said opening of said recessed portion is circular or polygonal.

2. The polishing pad of claim 1, which comprises a water-insoluble matrix and water-soluble particles dispersed in the water-insoluble matrix.

3. The polishing pad of claim 1, which has a base layer on the non-polishing surface.

4. The polishing pad of claim 1, wherein the recessed portion has a depth of 0.01 to 2.0 mm.

5. The polishing pad of claim 4, wherein the recessed portion has a depth of 0.1 to 1.5 mm.

6. The polishing pad of claim 5, wherein the recessed portion has a depth of 0.1 to 1.0 mm.

7. The polishing pad of claim 2, wherein the water-insoluble matrix comprises a cross-linked polymer component in an amount of at least 20 vol %.

8. The polishing pad of claim 7, wherein the water-insoluble matrix has a residual elongation after breakage of 100% or less when a specimen of the water-insoluble matrix is broken at 80° C. in accordance with JIS K 6251.

9. The polishing pad of claim 1, which has a shore D hardness of at least 35.

10. A method comprising chemical mechanical polishing of a surface to be polished with the polishing pad of claim 1.

11. The method of claim 10, wherein the opening of the recessed portion is circular, and the upper limit of its diameter is 100% of the diameter of the surface to be polished.

12. The method of claim 10, wherein the opening of the recessed portion is circular, and the upper limit of its diameter is 75% of the diameter of the surface to be polished.

13. The method of claim 10, wherein the opening of the recessed portion is circular, and the upper limit of its diameter is 50% of the diameter of the surface to be polished.

14. The method of claim 10, wherein the opening of the recessed portion is circular, and the lower limit of its diameter is 1 mm.

15. The method of claim 10, wherein the opening of the recessed portion is circular, and the lower limit of its diameter is 5 mm.

* * * * *